US009247333B2

(12) United States Patent
Akino

(10) Patent No.: US 9,247,333 B2
(45) Date of Patent: Jan. 26, 2016

(54) MICROPHONE DEVICE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/486,446

(22) Filed: Sep. 15, 2014

(65) Prior Publication Data

US 2015/0092975 A1 Apr. 2, 2015

(30) Foreign Application Priority Data

Sep. 30, 2013 (JP) ..... 2013-203177

(51) Int. Cl.

| | |
|---|---|
| ***H04R 9/08*** | (2006.01) |
| ***H04R 1/08*** | (2006.01) |
| ***F21V 33/00*** | (2006.01) |
| *F21Y 101/02* | (2006.01) |

(52) U.S. Cl.

CPC ..... *H04R 1/08* (2013.01); *F21V 33/0056* (2013.01); *F21Y 2101/02* (2013.01); *H04R 2499/15* (2013.01)

(58) Field of Classification Search

CPC ..... H04R 3/00; G09F 13/00; H05B 33/00

USPC ..... 381/355, 189, 122, 91, 172, 171, 395, 381/363, 168, 375, 110; 315/129, 291

See application file for complete search history.

(56) References Cited

U.S. PATENT DOCUMENTS

| | | | | |
|---|---|---|---|---|
| 2002/0001190 | A1* | 1/2002 | Everett | H04R 1/406 362/86 |
| 2003/0095675 | A1* | 5/2003 | Marlow | F02B 75/22 381/110 |
| 2009/0034778 | A1* | 2/2009 | Chi | 381/394 |

FOREIGN PATENT DOCUMENTS

| | | | |
|---|---|---|---|
| JP | 2009-188491 | A | 8/2009 |

* cited by examiner

*Primary Examiner* — Brian Ensey
*Assistant Examiner* — Julie X Dang
(74) *Attorney, Agent, or Firm* — Manabu Kanesaka

(57) ABSTRACT

There is provided a microphone device with which an operation state of the microphone device may be easily checked and that may effectively reduce noise to be played back, the noise being caused by vibration that has propagated through a table or the like. A microphone device is configured such that a microphone case 2 in which a microphone unit 3 for converting a speech wave into a speech signal is housed is supported by a stand arm 25 via a coupling member 11 formed of a light-transmissive elastic material, and light emitted from a light source (LED) 14 housed in the microphone case 2 or the stand arm 25 is projected to an outside through the coupling member. Control is performed such that the light source 14 is lit in an on state in which a speech signal is output from the microphone unit 3.

14 Claims, 2 Drawing Sheets

MICROPHONE DEVICE

BACKGROUND OF THE INVENTION

1. Field of the Invention

The present invention relates to a microphone device that may be preferably used as a microphone device that is for use in meetings and arranged, for example, on each of a rostrum and tables where attendees are seated, in a meeting hall.

2. Background of the Related Art

As microphone devices that may be arranged on each of a rostrum and tables where attendees are seated, gooseneck microphone devices are widely used. Such a gooseneck microphone device is equipped with a stand arm, which is long, composed of a flexible pipe, with which the angle and height thereof may be easily adjusted. A microphone case in which a microphone unit is housed is mounted on a tip portion of the stand arm.

Moreover, a small-sized and light condenser microphone is used in the microphone unit, which is used for the gooseneck microphone device. Thus, in order to cause an impedance converter of such a condenser microphone to operate, a phantom power supply method is used in which power may be obtained from the outside using signal lines of the microphone.

In a microphone system that is installed in the above-described meeting hall or the like, it is necessary to prevent inclusion of a noise component including an unnecessary conversation and the like. In order to realize this, there may be a case where control is performed such that a signal from microphones other than the microphone of a speaker is shut off (the microphones other than the microphone of the speaker are switched off) and only a speech signal from the microphone of the speaker is received (the microphone of the speaker is switched on).

For switching on/off of each microphone device, there may be a case where each attendee operates the switch of his/her microphone, and there may also be a case where an operator who may see the entire meeting hall remotely operates the switches of microphones of attendees.

Accordingly, for such a microphone device, a microphone device is provided including a display lamp (a light-emitting diode (LED)) configured to be lit to show the state of the microphone device.

FIG. 2 illustrates an example of a conventional gooseneck microphone device installed in the above-described meeting hall. A mounting hole Th for a stand arm that supports a microphone case is drilled in a portion of a rostrum or a table T where an attendee is seated in the meeting hall.

A gooseneck microphone device 1 is mounted on the table T using the mounting hole Th in a state in which the gooseneck microphone device 1 stands substantially upright.

Reference numeral 21 denotes a base housing of the gooseneck microphone device 1. The base housing 21 is formed like a cylinder. A bottom-end portion of the base housing 21 having a slightly reduced diameter is inserted into the mounting hole Th, which has been drilled in the table T, and fixed. A connector 21*a* is housed inside the base housing 21.

Note that, although not illustrated, a connection terminal for connecting the connector 21*a* inside the base housing 21 to a phantom power supply is arranged on the back side of the table T.

A stand arm 25 is configured above the base housing 21 by connecting in order a first flexible pipe 22, a relay pipe 23, and a second flexible pipe 24. A microphone case 2 in which a microphone unit is housed is mounted on a tip portion of the stand arm 25.

Moreover, in the gooseneck microphone device 1, a window hole 21*b* filled with a light transmissive member is formed in a portion of the base housing 21. A light source (an LED), not illustrated, serving as a display lamp is housed inside the base housing 21, the display lamp being lit while the gooseneck microphone device 1 is in an on state. Note that a gooseneck microphone device having the above-described configuration has been disclosed in Japanese Patent Application Publication No. 2009-188491, which will be described in the following.

In the gooseneck microphone device disclosed in Japanese Patent Application Publication No. 2009-188491, as described above, a light source (an LED) serving as a display lamp showing whether or not the gooseneck microphone device is in an on state is arranged in a portion of the base housing 21 to be mounted on a surface of a table. Accordingly, the arrangement position of the display lamp is close to the surface of the table and there is a problem in that it is difficult for attendees and an operator to recognize the state of the display lamp.

For example, in the case where the operator, who may see the entire meeting hall as described above, remotely performs on/off control on each microphone while managing communication, it is difficult for the operator to visually recognize microphones that are in the on state.

On the other hand, the gooseneck microphone device 1, which is installed in the above-described meeting hall, is mounted so as to stand on the table T. Thus, vibration caused when a relatively thick document or the like is moved on the table T and vibration caused as a result of operation of a keyboard or the like tend to easily propagate to the gooseneck microphone device 1 (the microphone unit) through the table T. Consequently, noise caused by vibration is easily captured by such a microphone device.

SUMMARY OF THE INVENTION

The present invention has been made in light of the above-described problems specific to a microphone device described above and used in a meeting hall or the like. It is an object of the present invention to provide a microphone device with which a control state of the microphone device as to whether it has been switched on/off may be easily checked and that may effectively reduce noise to be played back, the noise being caused by vibration that has propagated through a table or the like.

A microphone device according to the present invention includes a microphone case in which a microphone unit for converting a speech wave into a speech signal is housed, a coupling member formed of a light-transmissive elastic material and connected to the microphone case, a stand arm for supporting the microphone case via the coupling member, and a light source housed in the microphone case or the stand arm, wherein light emitted from the light source is projected to an outside through the coupling member.

The light source is configured to be lit in an on state in which a speech signal is output from the microphone unit.

Furthermore, as a preferred example of the coupling member, the coupling member includes a first coupling portion to be fitted into and coupled to a portion provided on the side where the microphone case is provided, a second coupling portion to be fitted into and coupled to a portion provided on the side where the stand arm is provided, and an optical display portion that is positioned between the first and second coupling portions and that projects, to the outside, light emitted from the light source.

In addition, desirably, the optical display portion is positioned at a central portion of the coupling member and formed to have a larger diameter than the first coupling portion and the second coupling portion. Furthermore, desirably, a shaft hole is formed in a shaft core portion extending over the first coupling portion, the optical display portion, and the second coupling portion of the coupling member, the shaft hole being a hollow through hole.

In the microphone device according to the present invention, a configuration is employed in which the microphone case in which the microphone unit is housed is supported by the stand arm with the coupling member formed of a light-transmissive elastic material therebetween.

With the configuration, light emitted from the light source housed in the microphone or the stand arm is projected to the outside through the coupling member. As a result, the optical display portion, which shows the operation state of the microphone device, may be arranged at a high position very near the microphone unit and the operation state of the microphone device may be easily checked.

In addition, vibration that propagates through the stand arm may be effectively shut off using an elastic material of which the coupling member is constituted. Thus, there may be provided a microphone device that may greatly reduce noise caused by vibration.

That is, the coupling member serves as the optical display portion and realizes a function through which noise caused by vibration is reduced. Consequently, the number of parts may be reduced and the product cost may also be reduced.

DESCRIPTION OF THE PREFERRED EMBODIMENTS

Figure 1:
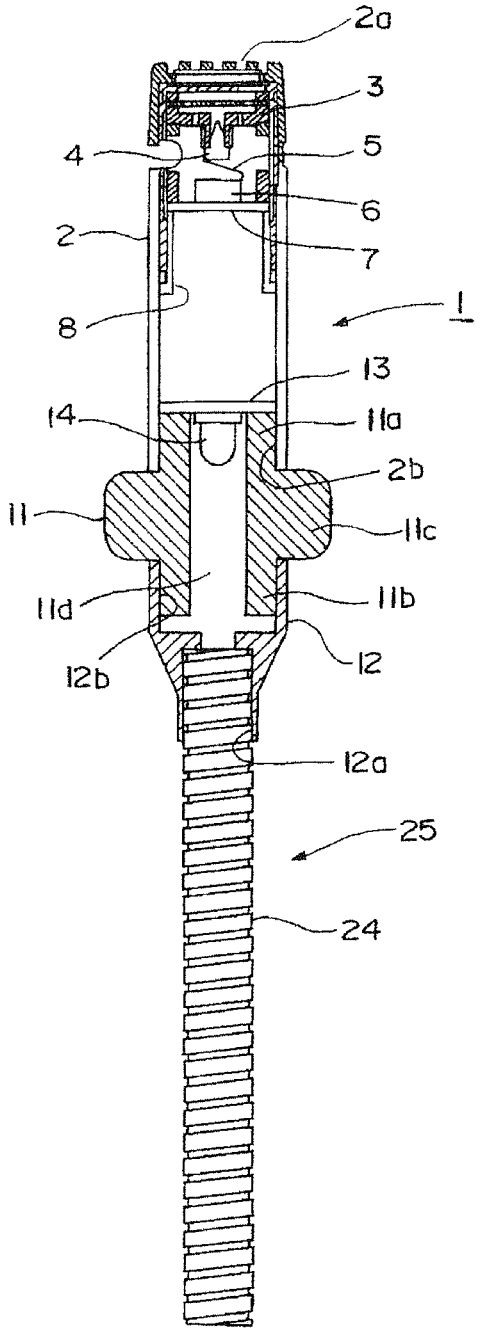
FIG. 1 is a cross sectional view illustrating a main portion of a microphone device according to the present invention.
Figure 2:
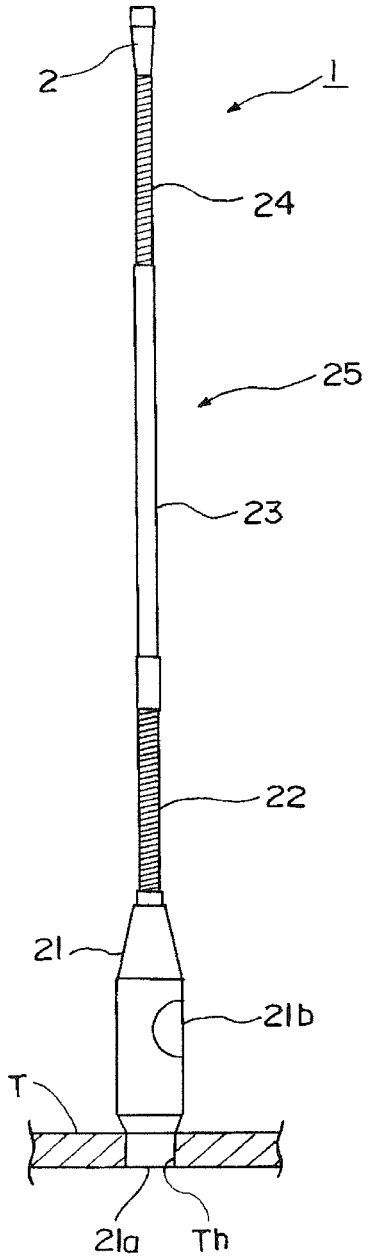
Fig. 2 Prior Art
FIG. 2 is an external view illustrating an example of a conventional gooseneck microphone device.

A microphone device according to the present invention will be described in accordance with an embodiment illustrated in FIG. 1. Note that the configuration illustrated in FIG. 1 illustrates a state in which a microphone case including a microphone unit is mounted on a top-end portion of a stand arm. In addition, the microphone device illustrated in FIG. 1 is similar to the gooseneck microphone device 1 provided with the stand arm 25, which has already been described using FIG. 2, in terms of the overall configuration.

Note that there is a difference in that display means that shows an operation state (an on state) of the microphone device according to the present invention is immediately below the microphone case, the display means being conventionally arranged at a base housing 21. This respect will be described later in detail.

In a microphone device 1 illustrated in FIG. 1, a microphone case 2 including a microphone unit is mounted on a top-end portion of a second flexible pipe 24. The configuration of the second flexible pipe 24 is the same as that of the second flexible pipe 24 of the stand arm 25 illustrated in FIG. 2.

That is, a sound intake portion 2*a* is configured by forming a plurality of slits in an end portion of the microphone case 2 (an top-end portion illustrated in FIG. 1), the end portion having a bottom, the microphone case 2 having been formed like a cylinder. Furthermore, a known condenser microphone unit 3 provided with diaphragm, a fixed electrode, and the like is arranged immediately below the sound intake portion 2*a* within the microphone case 2.

An output terminal pin 4 of the condenser microphone unit 3 is arranged on the back side of the condenser microphone unit 3 so as to be provided in a protruding manner. The output terminal pin 4 is connected to an impedance converter 6 including a field-effect transistor (FET) and the like via a contact 5, which is a leaf spring.

The impedance converter 6 is mounted on a substrate 7. The substrate 7, on which the impedance converter 6 has been mounted, is supported by a cylindrical inner tube 8 mounted inside the microphone case 2.

The other end portion (the bottom-end portion illustrated in FIG. 1) of the microphone case 2, in which the condenser microphone unit 3 and the like are housed, is fixed to a stand arm 25 with a coupling member 11 therebetween, and the microphone case 2 is supported by the stand arm 25.

Note that, in this embodiment, a mounting adapter 12 is mounted on the top-end portion of the second flexible pipe 24 of the stand arm 25. Thus, the microphone case 2 is connected to the second flexible pipe 24 of the stand arm 25 with the coupling member 11 and the mounting adapter 12 therebetween.

A fitting portion 12*a* of a cylindrical shape is formed in the mounting adapter 12. The fitting portion 12*a* is mounted on the top-end portion of the second flexible pipe 24 by fitting the second flexible pipe 24 into the fitting portion 12*a*. Moreover, the other end portion of the mounting adapter 12 is formed like a cylinder. An opening 12*b* of a large diameter is formed in the other end portion.

In addition, in this embodiment, an internal diameter of the opening 12*b*, which has a large diameter, of the mounting adapter 12 is configured to be substantially equal to an internal diameter of an opening 2*b* formed in the other end portion of the microphone case 2.

In contrast, the entirety of the coupling member 11 is formed of a light-transmissive elastic material. The coupling member 11 includes a first coupling portion 11*a*, a second coupling portion 11*b*, and an optical display portion 11*c*. The first coupling portion 11*a* is fitted into and coupled to the opening 2*b*, which is a portion provided on the side where the microphone case 2 is provided, and the second coupling portion 11*b* is fitted into and coupled to the opening 12*b* of the mounting adapter 12 on the side where the stand arm 25 is provided. The optical display portion 11*c* is positioned between the first coupling portion 11*a* and the second coupling portion 11*b*, and projects light emitted from a light source (an LED), which will be described later, to the outside.

In addition, the optical display portion 11*c* is formed to have a larger diameter than the first coupling portion 11*a* and the second coupling portion 11*b*, and is configured to be in a state in which the optical display portion 11*c* projects in an annular shape toward the outside from the microphone case 2 and the mounting adapter 12.

Furthermore, a shaft hole 11*d* is formed in a shaft core portion extending over the first coupling portion 11*a*, the optical display portion 11*c*, and the second coupling portion 11*b* in the coupling member 11, the shaft hole 11*d* being a straight and hollow hole penetrating through the shaft core portion.

A light source (an LED) 14 mounted on a substrate 13 is arranged inside the opening 2*b* of the microphone case 2. By inserting and fitting the first coupling portion 11*a* into the opening 2*b*, the light source 14 is arranged such that the light source 14 faces the inside of the shaft hole 11*d* formed in the coupling member 11.

Moreover, the light source (an LED) 14 is controlled to be lit in an on state in which a speech signal is output from the condenser microphone unit 3.

With this configuration, light emitted from the light source (an LED) 14 passes from inside the shaft hole 11*d* formed in the coupling member 11 through the coupling member 11 and is projected to the outside by the optical display portion 11*c*, the optical display portion 11*c* being formed to project in an annular shape.

Furthermore, signal lines for a speech signal from the condenser microphone unit 3, a lead for switching on the light source (an LED) 14, and the like may be housed and arranged, as appropriate, in the shaft hole 11*d* formed in the coupling member 11.

As an example of the light-transmissive elastic material that constitutes the coupling member 11, a "SEIKEIYOU TOUMEI SHILIKO-N GOMU", which is the name of a product provided by Tomita Mateqs Co., Ltd. (Ichiban-cho, Aoba-ku, Sendai city), may be preferably used.

For this "SEIKEIYOU TOUMEI SHILIKO-N GOMU", there are provided rubber products each having a rubber hardness that is anywhere from 40 degrees to 80 degrees. Product numbers TSCE4000 to TSCE8000 are determined in accordance with rubber hardness.

For the light-transmissive elastic material, there are provided materials having a luminous transmittance of up to on the order of 95%, and furthermore there are provided rubber products each having a rubber hardness that is anywhere from 40 degrees to 80 degrees. Thus, selection may be made as appropriate.

As is clear from the above-described description, a microphone device according to the present invention may effectively shut off vibration that propagates through the stand arm 25 and may reduce noise caused by vibration in the condenser microphone unit 3 by using a light-transmissive elastic material for the coupling member 11, which is to be used in the microphone device.

Moreover, the optical display portion 11*c*, which projects in an annular shape, is formed in the coupling member 11, and the optical display portion 11*c* emits light in a ring-shaped manner at a high position very near the condenser microphone unit 3. Thus, operational effects may be achieved as described in the summary of the invention, an example of the operational effects being that an operation state of a microphone device may be easily checked.

Note that, in the above-described embodiment, a configuration is employed in which the light source (an LED) 14, which is lit while the microphone device is in the on state, is arranged inside the microphone case 2. However, similar operational effects may also be achieved with a configuration in which the light source 14 is arranged on the side where the stand arm 25 is provided, for example, in the mounting adapter 12 mounted on the second flexible pipe 24. Moreover, the above-described microphone device may be preferably used especially in meeting halls; however, may also be used, as a matter of course, not only in meeting halls but also for other purposes.

What is claimed is:

1. A microphone device comprising:

a microphone unit, a microphone case in which the microphone unit for converting a speech wave into a speech signal is housed, a coupling member formed of a light-transmissive elastic material and connected to the microphone case, a stand arm for supporting the microphone case to be self-stood via the coupling member, and a light source housed in the microphone case or the stand arm, wherein the coupling member is arranged between the microphone case and the stand arm such that the light-transmissive elastic material effectively shuts off a vibration propagating through the stand arm to the microphone unit, and a light emitted from the light source is projected to an outside through the coupling member.

2. The microphone device according to claim 1, wherein the light source is lit in an on state in which the speech signal is output from the microphone unit.

3. The microphone device according to claim 1, wherein the coupling member includes a first coupling portion to be fitted into and coupled to a portion provided on one side where the microphone case is provided, a second coupling portion to be fitted into and coupled to a portion provided on another side where the stand arm is provided, and an optical display portion that is positioned between the first and second coupling portions and that projects, to the outside, the light emitted from the light source.

4. The microphone device according to claim 2, wherein the coupling member includes a first coupling portion to be fitted into and coupled to a portion provided on one side where the microphone case is provided, a second coupling portion to be fitted into and coupled to a portion provided on another side where the stand arm is provided, and an optical display portion that is positioned between the first and second coupling portions and that projects, to the outside, the light emitted from the light source.

5. The microphone device according to claim 3, wherein the optical display portion is positioned at a central portion of the coupling member and formed to have a larger diameter than the first coupling portion and the second coupling portion.

6. The microphone device according to claim 4, wherein the optical display portion is positioned at a central portion of the coupling member and formed to have a larger diameter than the first coupling portion and the second coupling portion.

7. The microphone device according to claim 3, wherein a shaft hole is formed in a shaft core portion extending over the first coupling portion, the optical display portion, and the second coupling portion of the coupling member, the shaft hole being a hollow through hole.

8. The microphone device according to claim 4, wherein a shaft hole is formed in a shaft core portion extending over the first coupling portion, the optical display portion, and the second coupling portion of the coupling member, the shaft hole being a hollow through hole.

9. The microphone device according to claim 5, wherein a shaft hole is formed in a shaft core portion extending over the first coupling portion, the optical display portion, and the second coupling portion of the coupling member, the shaft hole being a hollow through hole.

10. The microphone device according to claim 6, wherein a shaft hole is formed in a shaft core portion extending over the first coupling portion, the optical display portion, and the second coupling portion of the coupling member, the shaft hole being a hollow through hole.

11. The microphone device according to claim 1, wherein the microphone device is a gooseneck microphone device.

12. The microphone device according to claim 1, further comprising a mounting adapter connecting the coupling member and the stand arm, wherein the microphone case includes a case opening and the mounting adapter includes an adapter opening; and the coupling member includes a first coupling portion fitted into the case opening, a second coupling portion fitted into the adapter opening, and an optical display portion arranged between the first and second coupling portions and protruding annularly outwardly over outer peripheries of the microphone case and the mounting adapter to project the light emitted from the light source to the outside though the coupling member.

13. The microphone device according to claim 12, further comprising a substrate arranged inside the case opening, wherein the light source is mounted on the substrate in the microphone case, and the coupling member has a shaft hole penetrating therethrough so that when the coupling member is accommodated in the microphone case, the light source is disposed in the shaft hole of the coupling member.

14. The microphone device according to claim 13, wherein the light-transmissive elastic material is a silicon rubber.

* * * * *